US008444347B2

(12) United States Patent
Xu

(10) Patent No.: US 8,444,347 B2
(45) Date of Patent: May 21, 2013

(54) TRUSS HEAVE PLATE SYSTEM FOR OFFSHORE PLATFORM

(75) Inventor: Qi Xu, Katy, TX (US)

(73) Assignee: Technip France, Courbevoie (FR)

( * ) Notice: Subject to any disclaimer, the term of this patent is extended or adjusted under 35 U.S.C. 154(b) by 281 days.

(21) Appl. No.: 12/849,322

(22) Filed: Aug. 3, 2010

(65) Prior Publication Data

US 2012/0034034 A1 Feb. 9, 2012

(51) Int. Cl.
*E02B 17/08* (2006.01)

(52) U.S. Cl.
USPC ..... 405/196

(58) Field of Classification Search
USPC ..... 405/196, 197, 200, 219, 203, 195.1; 114/264, 265; 166/355
See application file for complete search history.

(56) References Cited

U.S. PATENT DOCUMENTS

| | | | | | |
|---|---|---|---|---|---|
| 2,399,656 | A * | 5/1946 | Armstrong | 114/265 |
| 2,651,181 | A * | 9/1953 | Alcorn et al. | 405/204 |
| 2,837,897 | A * | 6/1958 | Nedderman et al. | 405/196 |
| 2,938,352 | A * | 5/1960 | Knapp et al. | 405/207 |
| 2,938,354 | A * | 5/1960 | Knapp | 405/206 |
| 3,001,370 | A * | 9/1961 | Templeton | 405/200 |
| 3,277,653 | A * | 10/1966 | Foster | 405/200 |
| 3,420,066 | A * | 1/1969 | Bishop | 405/227 |
| 3,673,974 | A * | 7/1972 | Harper | 114/265 |
| 3,986,471 | A * | 10/1976 | Haselton | 114/265 |
| 3,996,754 | A * | 12/1976 | Lowery | 405/197 |
| 4,007,598 | A * | 2/1977 | Tax | 405/200 |
| 4,325,654 | A * | 4/1982 | Meckler | 405/196 |
| 4,329,088 | A * | 5/1982 | Lucas | 405/196 |
| 4,678,372 | A * | 7/1987 | Cousty | 405/196 |
| 4,743,141 | A * | 5/1988 | Simensen et al. | 405/195.1 |
| 5,174,687 | A * | 12/1992 | Dunlop et al. | 405/223.1 |
| 5,507,596 | A * | 4/1996 | Bostelman et al. | 405/191 |
| 5,558,467 | A * | 9/1996 | Horton | 405/195.1 |
| 6,196,767 | B1 * | 3/2001 | Thomas | 405/203 |

(Continued)

FOREIGN PATENT DOCUMENTS

| | | |
|---|---|---|
| EP | 2 204 497 | 7/2010 |
| WO | 03/011682 | 2/2003 |

OTHER PUBLICATIONS

Isailovski, M., International Search Report for International Patent Application No. PCT/US2011/046075, dated Oct. 31, 2011, European Patent Office.

(Continued)

*Primary Examiner* — Thomas B Will
*Assistant Examiner* — Patrick Lambe
(74) *Attorney, Agent, or Firm* — Locke Lord LLP

(57) ABSTRACT

The disclosure provides an offshore platform and related method, having: a floating structure, a truss assembly coupled to the floating structure, and a heave plate coupled to the truss assembly. The floating structure includes a pontoon adapted to be disposed at least partially below a surface of water in which the offshore platform is disposed; and at least three vertically extending columns coupled to the pontoon, the columns having a larger lateral dimension than the pontoon coupled to the column, creating a pontoon offset portion. The truss assembly includes at least three separated walls of trusses slidably coupled to the columns, each truss wall having at least two vertically disposed truss legs, each truss leg being slidably coupled to a column at the pontoon offset portion independently from a truss leg of an adjacent wall; and cross-bracing between the truss legs of each of the truss walls.

13 Claims, 5 Drawing Sheets

U.S. PATENT DOCUMENTS

| | | | | |
|---|---|---|---|---|
| 6,352,116 | B1 * | 3/2002 | Børseth | 166/359 |
| 6,375,391 | B1 * | 4/2002 | Børseth et al. | 405/224.4 |
| 6,637,979 | B2 * | 10/2003 | Finn et al. | 405/224.2 |
| 6,648,555 | B2 * | 11/2003 | Mommaas et al. | 405/224 |
| 6,652,192 | B1 * | 11/2003 | Xu et al. | 405/195.1 |
| 6,761,124 | B1 * | 7/2004 | Srinivasan | 114/264 |
| 7,156,040 | B2 * | 1/2007 | Merchant et al. | 114/293 |
| 7,219,615 | B2 * | 5/2007 | Merchant et al. | 114/265 |
| 2003/0031517 | A1 * | 2/2003 | Wetch | 405/205 |
| 2003/0044239 | A1 | 3/2003 | Finn et al. | |
| 2005/0129464 | A1 * | 6/2005 | Moncus et al. | 405/203 |
| 2005/0158125 | A1 * | 7/2005 | Thomas et al. | 405/203 |
| 2006/0067793 | A1 * | 3/2006 | Murray | 405/205 |
| 2008/0014024 | A1 * | 1/2008 | Lokken et al. | 405/195.1 |
| 2008/0115714 | A1 * | 5/2008 | Tahar et al. | 114/264 |
| 2010/0260554 | A1 * | 10/2010 | Ding et al. | 405/195.1 |

OTHER PUBLICATIONS

Isailovski, M., Written Opinion for International Patent Application No. PCT/US2011/046075, dated Oct. 31, 2011, European Patent Office.

* cited by examiner

TRUSS HEAVE PLATE SYSTEM FOR OFFSHORE PLATFORM

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The disclosure relates generally to a system and method for offshore floating structures for use in the oilfield and related industries for exploration and extraction of minerals and resources from below surface waters. More specifically, the disclosure relates to a system and method for semi-submersible offshore platforms.

2. Description of the Related Art

With the significantly increasing demand on the oil and gas supply, offshore exploration and production from reservoirs has become vital to such supply. These reservoirs usually require large drilling rigs and variable payloads which result in very large topsides in both size and weight. Large and expensive supporting offshore platforms are needed. However, the expense of such platforms can be decreased by building such a floating structure near or on shore and towing the structure to the intended offshore site.

Among the main types of offshore platforms designed for deep water, including the popular Spar, a type of platform is known as a semi-submersible platform. The structure is built near or on shore, floated to the offshore site, and the partially submerged using ballast tanks to provide stability to the structure. Semi-submersibles are typically configured with large buoyant pontoon structures below the water surface and slender columns passing through the water surface supporting a topsides deck at a significant height above the water surface. Semi-submersible platforms make large and cost effective platforms for drilling and production of offshore oil and gas. However, because the structure has a relatively large floating surface, one challenge is restricting movement caused by wave and wind action to provide a desired stability for operations.

Heave plates have been used to stabilize movement of the semi-submersible platforms. The heave plate can be a solid plate or a constructed assembly of a plurality of plates that form a box to form a relatively large horizontal surface area, but is relatively thin vertically. The heave plate is mounted to the semi-submersible platform below the water surface and below at least a portion of the wave-influenced water zones. The heave plate increases the hydrodynamic mass of the offshore platform, where hydrodynamic mass is a measure of the amount of a fluid moving with a body that accelerates in the fluid and depends on the shape of the body and the direction of its motion. The heave plate at the lower depths provides additional resistance to vertical and tilting motion that would otherwise occur near or at the water surface. Thus, designers are motivated to mount the heave plate at deeper levels. However, the depth is initially limited, because the platform is built near or on shore at shallow depths. Thus, some systems have a lowering capability to the heave plate. The heave plate can be lowered to a more desirable depth after the platform is in position at the intended offshore site. Examples of such systems are illustrated, for example, in U.S. Pat. No. 6,652,192 and U.S. Pat. No. 7,219,615 (as a continuation of U.S. Pat. No. 7,156,040), and are incorporated by reference herein. Each of these systems discloses lowering the heave plate to a depth below the platform after being located to the intended offshore site.

U.S. Pat. No. 6,652,192 discloses a heave suppressed, floating offshore drilling and production platform having vertical columns, lateral trusses connecting adjacent columns, a deep-submerged horizontal plate supported from the bottom of the columns by vertical truss legs, and a topside deck supported by the columns. The lateral trusses connect adjacent columns near their lower end to enhance the structural integrity of the platform. During the launch of the platform and towing in relatively shallow water, the truss legs are stowed in shafts within each column, and the plate is carried just below the lower ends of the columns. After the platform has been floated to the deep water drilling and production site, the truss legs are lowered from the column shafts to lower the plate to a deep draft for reducing the effect of wave forces and to provide heave and vertical motion resistance to the platform. Water in the column shafts is then removed for buoyantly lifting the platform so that the deck is at the desired elevation above the water surface.

U.S. Pat. No. 7,219,615 discloses a semi-submersible vessel having a pair of vertically spaced pontoons with varied buoyancy. The lower pontoon is retained in a close vertical proximity to the upper pontoon when the vessel is in transit. The lower pontoon is ballasted at the deployment site, dropping the pontoon to a depth of about 32 meters below the first pontoon baseline. As a result, stability and motion characteristics of the vessel are significantly improved.

While each of these systems offer solutions for a stabilized platform having a lowered heave plate, in practice the supporting structure for the heave plate to the platform may suffer from rigidity challenges. For example, U.S. Pat. No. 7,219,615 discloses extendable legs. Due to the extendable nature of the legs, no diagonal bracing between legs is shown that would be able to resist twisting and bending of the extended support structure to the heave plate, because diagonal bracing between the legs would apparently interfere with extending and retracting the legs through the guides. U.S. Pat. No. 6,652,192 illustrates extendable trusses within columns having diagonal flexible cable bracing installed between trusses after extension of the legs. Due to an interference between the truss diagonal members and the column, it is hard to design a receptacle which can enclose the truss legs and rigid diagonal bracing for effective support and load transfer. The patent does not disclose rigid bracing between trusses for the same reason, namely, the rigid bracing between the trusses would appear to interfere with extending and retracting the trusses.

Further, the designs may also suffer from strength of connections between the trusses and columns of the offshore platform. When the trusses are coupled to the columns, generally the coupling is in a cantilever fashion. A cantilever support at a corner of a column can extend outwardly to a corner of a truss assembly, so that each corner of the truss assembly can be attached to the cantilever support. For example, a four-sided truss assembly could be supported by four cantilever supports at each corner. Such an example is illustrated in FIG. 11A of U.S. Pat. No. 6,652,192. The large loads created by the truss, and the heave plate coupled to the truss, can cause design challenges in making such a cantilevered support structurally and economically efficient.

There remains a need for a different system and method for an offshore platform having an improved truss system coupled to a heave plate that can be lowered in elevation.

BRIEF SUMMARY OF THE INVENTION

The purpose of this invention is to improve the truss design for a simple and reliable connection to the supporting columns of an offshore floating platform. Advantageously, the disclosure provides for separating a typical box-like truss assembly generally having at least three vertical planes of structural members into separate planar elements, herein "truss walls", with each truss wall having at least two legs. Cross-bracing can be coupled between the legs in the plane of the truss wall. Each truss wall having at least two legs can be independently guided along the offshore platform columns. Further, each truss leg can be supported on three of its sides, providing additional supporting structures compared to prior efforts. The disclosure provides an elegant solution in the truss-to-column connection design and the improved load path from the truss to the columns in the offshore platform. Also, due to the increased number of truss legs, structural redundancy is improved.

The disclosure provides an offshore platform, having: a floating structure, a truss assembly coupled to the floating structure, and a heave plate coupled to the truss assembly. The floating structure includes a pontoon adapted to be disposed at least partially below a surface of water in which the offshore platform is disposed; and at least three vertically extending columns coupled to the pontoon, the columns having a larger lateral dimension than the pontoon coupled to the column, creating a pontoon offset portion. The truss assembly includes at least three separated walls of trusses slidably coupled to the columns, each truss wall having at least two vertically disposed truss legs, each truss leg being slidably coupled to a column at the pontoon offset portion independently from a truss leg of an adjacent wall; and cross-bracing between the truss legs of each of the truss walls.

The disclosure also provides a method of lowering a heave plate of a floating offshore platform, the offshore platform having a floating structure with at least three vertically extending columns coupled to a pontoon creating a pontoon offset portion and a truss assembly coupled to the floating structure having at least three walls of trusses coupled to the heave plate, each truss wall having at least two vertically disposed truss legs, each leg being slidably coupled to a column at the pontoon offset portion independently from a leg of an adjacent truss wall, the method comprising: lowering each truss wall while guiding each leg of the truss wall at the pontoon offset portion; and supporting each leg of the truss walls from the pontoon in a lowered position independently of the legs of an adjacent truss wall.

DETAILED DESCRIPTION

Figure 1A:
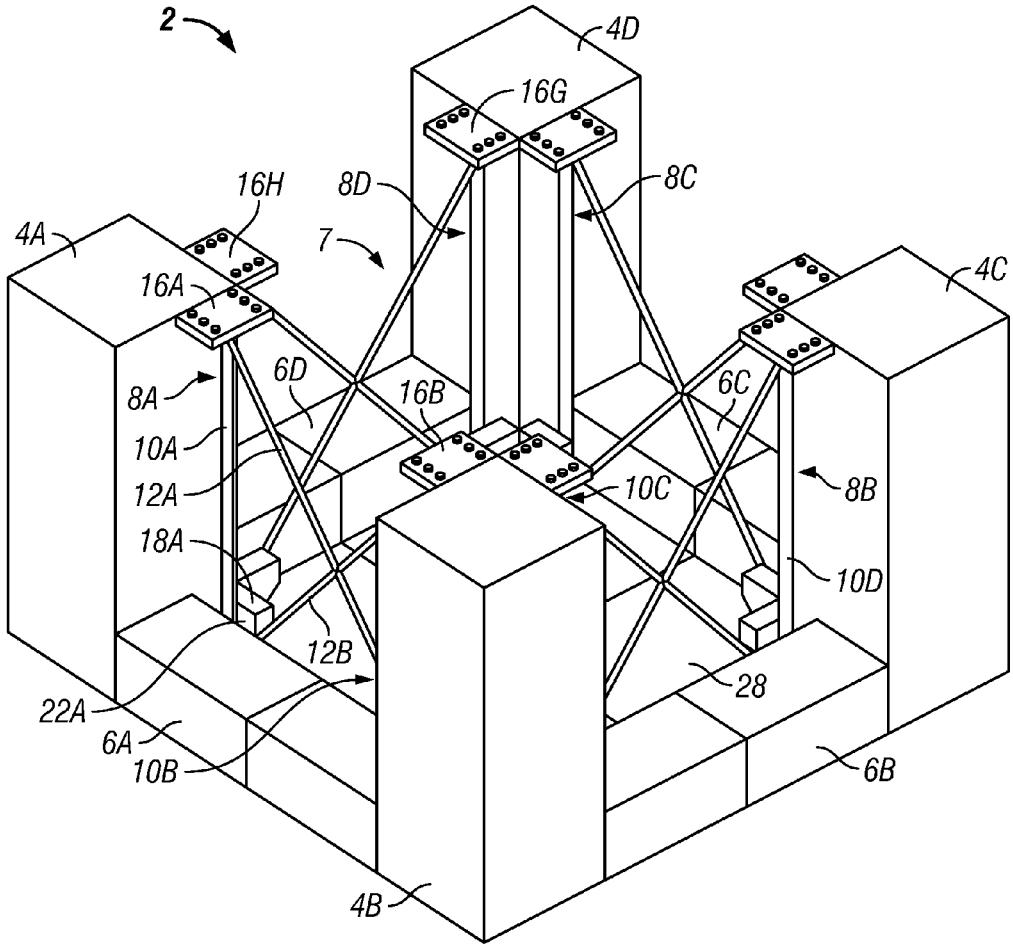
FIG. 1A is a schematic perspective view of a floating offshore platform having truss walls and a heave plate in a raised position.

The Figures described above and the written description of specific structures and functions below are not presented to limit the scope of what Applicant has invented or the scope of the appended claims. Rather, the Figures and written description are provided to teach any person skilled in the art how to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location, and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. Where appropriate, some elements have been labeled with an alphabetic character after a number to reference a specific member of the numbered element to aid in describing the structures in relation to the Figures, but is not limiting in the claims unless specifically stated. When referring generally to such members, the number without the letter is used. Further, such designations do not limit the number of members that can be used for that function.

The disclosure provides an offshore platform, having: a floating structure, a truss assembly coupled to the floating structure, and a heave plate coupled to the truss assembly. The floating structure includes a pontoon adapted to be disposed at least partially below a surface of water in which the offshore platform is disposed; and at least three vertically extending columns coupled to the pontoon, the columns having a larger lateral dimension than the pontoon coupled to the column, creating a pontoon offset portion. The truss assembly includes at least three separated walls of trusses slidably coupled to the columns, each truss wall having at least two vertically disposed truss legs, each truss leg being slidably coupled to a column at the pontoon offset portion independently from a truss leg of an adjacent wall; and cross-bracing between the truss legs of each of the truss walls. The disclosure also provides a method of lowering a heave plate.

Figure 1B:
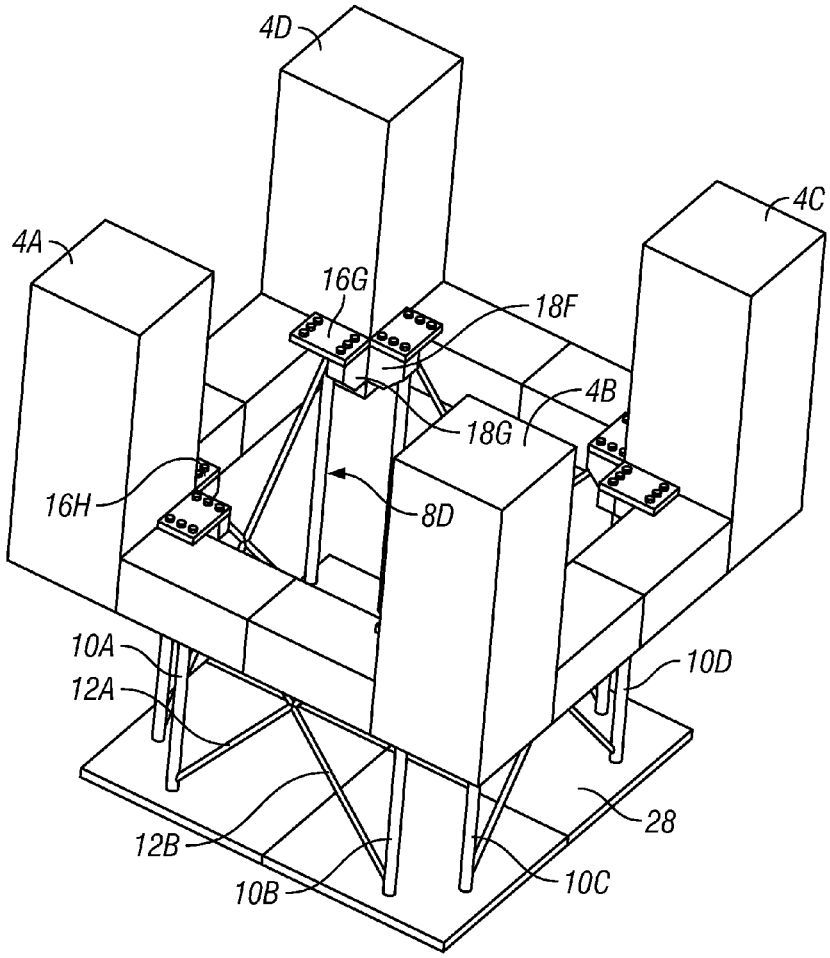
FIG. 1B is a schematic perspective view of the floating offshore platform with the heave plate in a lowered position.

FIG. 1A is a schematic perspective view of a floating offshore platform having truss walls and a heave plate in a raised position. FIG. 1B is a schematic perspective view of the floating offshore platform with the heave plate in a lowered position. FIG. 10 is a schematic detailed perspective view of a corner of the floating offshore platform shown in FIG. 1B with the truss wall in a lowered position. The figures will be described in conjunction with each other. Generally, an offshore platform 2 generally includes one or more columns 4 coupled to one or more pontoons 6. A heave plate 28 is slidably coupled to the columns via a truss assembly 7 having a plurality of truss walls 8. To illustrate the aspects disclosed herein, a four-column offshore platform is shown with the express understanding that less or more columns can be used following the same or similar principles disclosed herein.

More particularly, the offshore platform 2 includes a first column 4A, a second column 4B, a third column 4C, and in some embodiments, a fourth column 4D, and more. The pontoons 6 can be disposed between the columns 4. For example, the pontoon 6A is disposed between the column 4A and the column 4B. The pontoon 6B is disposed between the column 4B and the column 4C. The pontoon 6C is disposed between the column 4C and the column 4D. The pontoon 6D is disposed between the column 4D and the column 4A. Generally, the pontoon has a different lateral dimension than the column to which it is coupled. Generally, the pontoon will be smaller than the column as shown in the detail of FIG. 1A. The intersection of coupling between the pontoon and the column yields a remaining portion referred to herein as a "pontoon offset portion" 24. For example, the pontoon 6C coupled to the column 4D provides a pontoon offset portion 24F, as illustrated in FIG. 10. The pontoon 6D coupled to the column 4D provides a pontoon offset portion 24G.

It is understood that the pontoons 6 are shown coupled outwardly to the corresponding column 4, so that the pontoon offset portions 24 are defined inwardly toward a center of the platform. Alternatively, the pontoon 6 can be coupled inwardly with the column 4 toward the center of the platform 2, so that the pontoon offset portion 24 is defined outwardly from the center of the platform, or some position therebetween. With an outwardly disposed pontoon offset portion 24, the truss walls 8 could be disposed outwardly from the pontoon 6 in like manner, using outwardly disposed porches 18 and guide channels 22, referenced below.

The truss assembly 7 includes a plurality of truss walls 8. The truss walls 8 generally are separated from each other, that is, a first truss wall does not share a common corner to a second truss wall disposed at an angle to the first truss wall. However, the truss walls 8 are coupled to the heave plate 28 disposed below the columns 4. The truss walls 8 are slidably coupled to the columns 4. As the heave plate 28 lowers to a desired elevation, the truss walls 8 can also lower relative to the columns 4. More specifically, a truss wall 8A can be disposed between the column 4A and column 4B. A truss wall 8B can be disposed between the column 4B and column 4C. A truss wall 8C can be disposed between the column 4C and column 4D. A truss wall 8D can be disposed between the column 4B and the column 4A. Each truss wall 8 generally includes at least two truss legs 10. For example, a truss wall 8A includes truss leg 10A and a truss leg 10B. Further, truss braces 12 provide rigidity to the truss wall 8, and are generally disposed planar to the truss legs 10A, 10B. For example, the truss wall 8A can include a truss brace 12A disposed between the truss leg 10A and 10B in a first direction, and another truss brace 12B disposed between the truss 10A and 10B in a second direction. Generally, such directions will be diagonally, that is, in a nonhorizontal angle. However, any cross-bracing direction that is nonparallel to the leg 10 is contemplated herein.

Figure 1C:
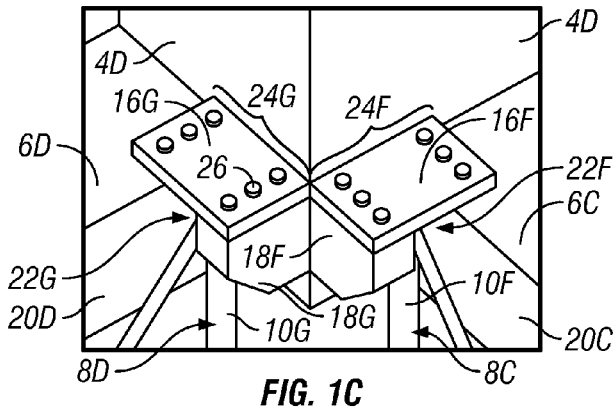
FIG. 1C is a schematic detailed perspective view of a corner of the floating offshore platform shown in FIG. 1B with the truss wall in a lowered position.

A porch 18 can be coupled to the column 4. Generally, at least two porches 18 will be coupled to each column 4 at angles to each other, because at least two truss walls 8 will be interfacing the column separate from each other. More specifically, as shown in FIGS. 1B, 1C, a porch 18F can be coupled to the column 4D at the pontoon offset portion 24F. Another porch 18G can be coupled to the column 4D at the pontoon offset portion 24G at an angle to the porch 18F. The size of the column 4D with the pontoon 6C in relation to the size of the porch 18F defines a guide channel 22F in the pontoon offset portion 24F. Likewise, the size of the column 4D with the pontoon 6D in relation to the size of the porch 18G defines a guide channel 22G in the pontoon offset portion 24G. The guide channels 22F, 22G are sufficiently large enough to allow the truss legs 10F, 10G, of the truss walls 8C, 8D, respectively, to be guided as such truss legs are lowered (and raised) with the heave plate 28. A corresponding guide channel (not shown) defined by the pontoon 6D and a corresponding porch coupled to column 4A for the other side of the truss wall 8D provides overall guidance for the truss wall 8D in two locations for each truss wall independent of guide surfaces for other truss walls. Other pontoon offset portions, porches, and guide channels defined therein can be used to guide the other truss walls.

In at least one embodiment, a leg support 16 can be coupled to the truss leg 10 of the truss wall. For example, the truss leg 10A can be coupled with a leg support 16A, and the truss leg 10B can be coupled with a leg support 10B. The leg support 16 is generally disposed at an upper location of the corresponding truss leg 10 and is intended to limit a downward lowering of the truss leg and hence the heave plate 28 coupled thereto. In a non-limiting and exemplary embodiment, the leg support 16 can be a cross-member, such as a plate or other structural element, that can span the corresponding guide channel 22 and be supported by the relevant pontoon 6 on one side and the relevant porch 18 on the other side when the truss leg 10 has been lowered with the heave plate 18. For example, the leg support 16G can be supported by the pontoon 6D on one end of the leg support and by the porch 18G on the other end. In at least one embodiment, the leg support 16 can be coupled by a fastener 26 to the pontoon 6 and/or the porch 18. The number of fasteners 26 coupling the leg support to the pontoon or porch can create a redundancy of members and add additional safety to the assembly. Additionally, the fastening of the leg support to the pontoon and/or porch can be accomplished by welding, grouting, and so forth.

Further, the pontoon 6 can include a spacer (not shown) to adjust the elevation limit for lowering the truss wall 8 and hence the heave plate 28. The porch 18 can be coupled to the column 4 at the level of the spacer. The elevation limit could be designed, so that the leg support 16 can be readily coupled to the spacer of the pontoon 6 and the porch 18 at a level just above the water surface, such as by welding or securing with fasteners, while still allowing the pontoon to be ballasted to some desired depth below the water.

Thus, the disclosure advantageously guides truss walls at two locations for each truss wall (generally on each side of the truss wall), effectively doubling the amount of guiding surfaces for the truss walls over prior efforts. Further, the leg supports spanning the pontoon offset portions can provide a non-cantilevered support for the truss legs of the truss wall using the pontoons and porches, effectively doubling the support surfaces for the truss legs over prior efforts. The different and novel arrangement can provide for greater structural integrity.

The manner lowering the heave plate is not critical to the disclosure and any suitable means can be used as is known to those with ordinary skill in the art. Non-limiting examples, include winches with cable coupled to the truss walls and/or heave plate, hydraulic systems, linear actuators, and other systems providing movement.

Figure 2A:
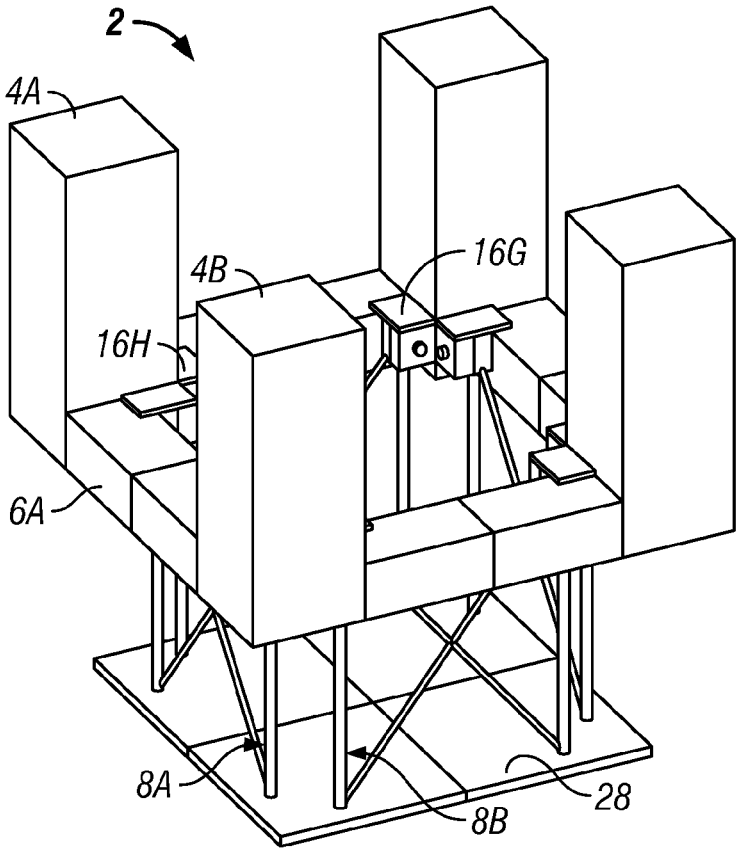
FIG. 2A is a schematic perspective view of another embodiment of the floating offshore platform having truss walls and a heave plate in a lowered position.
Figure 2B:
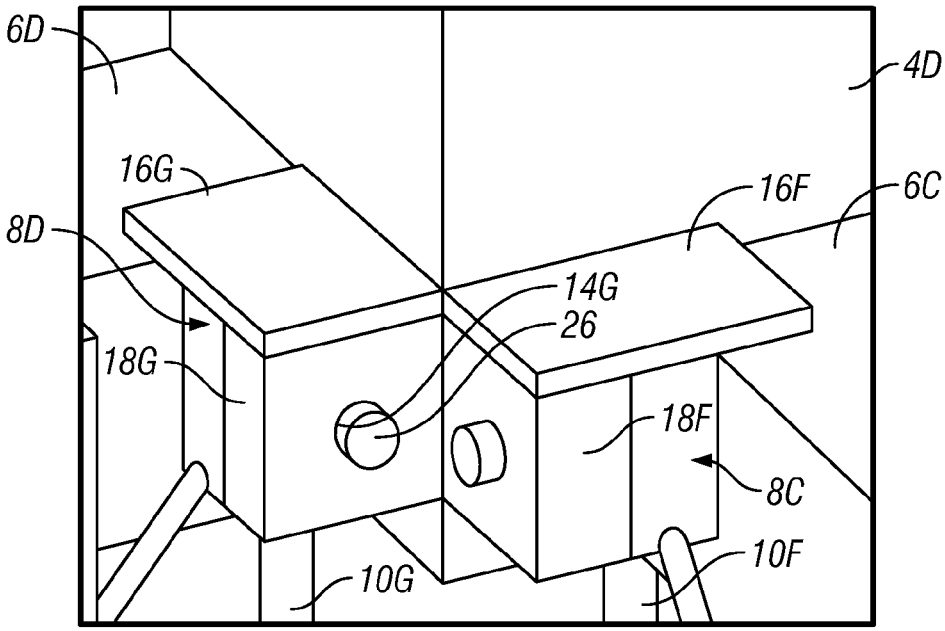
FIG. 2B is a schematic detailed perspective view of a corner of the floating offshore platform shown in FIG. 2A with the truss wall in a lowered position.

FIG. 2A is a schematic perspective view of another embodiment of the floating offshore platform having truss walls and a heave plate in a lowered position. FIG. 2B is a schematic detailed perspective view of a corner of the floating offshore platform shown in FIG. 2A with the truss wall in a lowered position. The figures will be described in conjunction with each other. The embodiment shown in FIGS. 2A, 2B can be similarly constructed as described above in FIGS. 1A-1C. However, when the heave plate 28 is in a lowered position, the leg support 16 can be coupled to the porch 18 and/or the pontoon 6 by a horizontally disposed fastener 26 in lieu of or in addition to the fasteners 26 shown in FIGS. 1A-1C. For example, the truss wall 8D can be lowered into position, so that the leg support 16G rests on the porch 18G in the pontoon 6D. To secure the truss wall 8D in such position, a fastener 26 could be inserted through an opening 14G in the porch 18G and would go through the leg 10G and generally into the pontoon 6D. The fastener 26 generally would need to be further secured, such as by cross-pinning, welding, or other ways of securing the fastener into position.

Figure 3A:
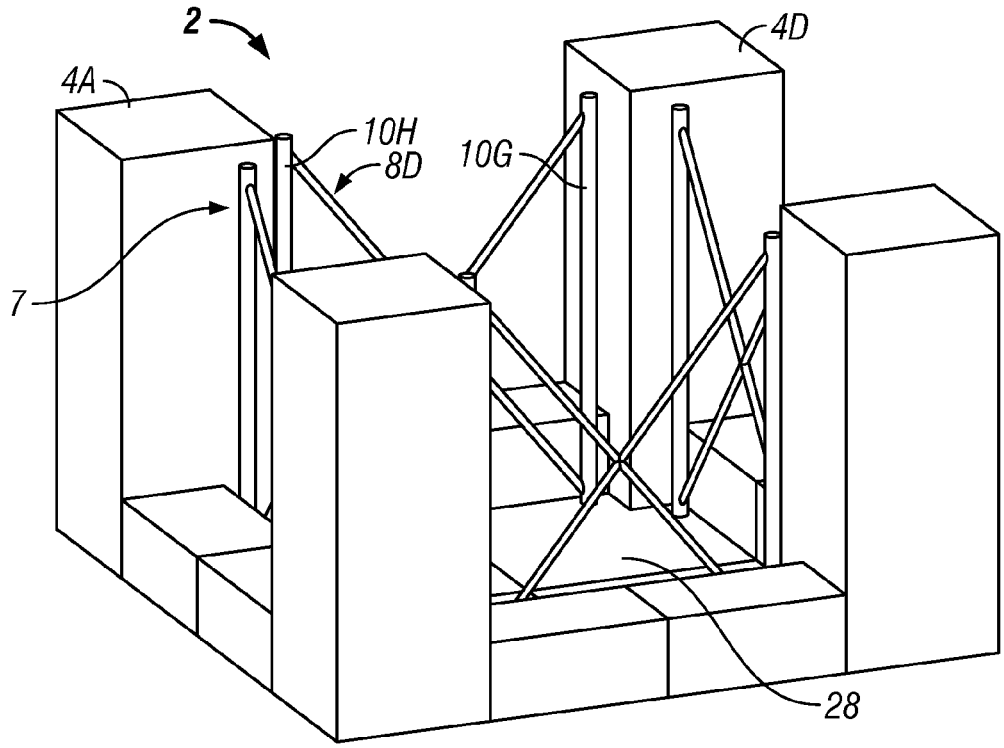
FIG. 3A is a schematic perspective view of another embodiment of the floating offshore platform having truss walls and a heave plate in a raised position.
Figure 3B:
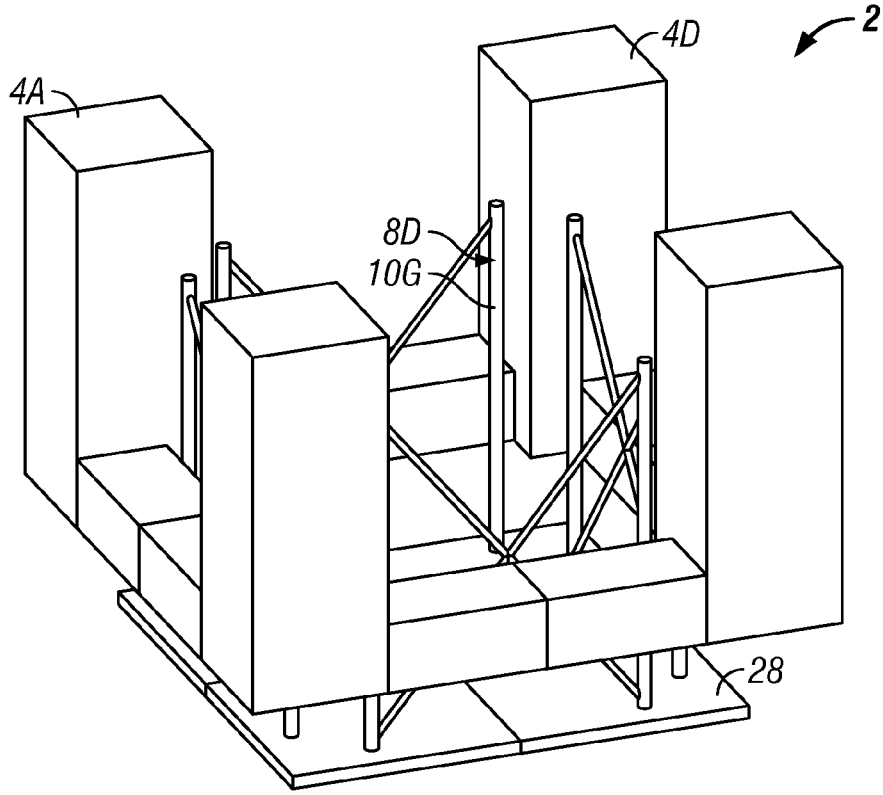
FIG. 3B is a schematic perspective view of the floating offshore platform with the heave plate in a partially lowered position.
Figure 3D:
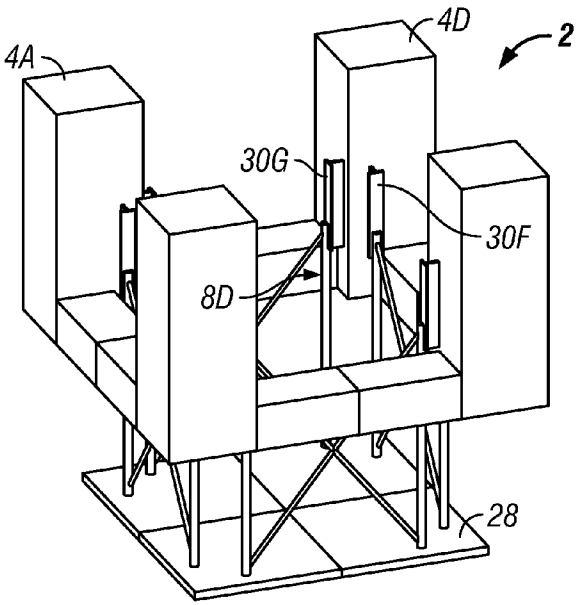
FIG. 3D is a schematic perspective view of the floating offshore platform with the heave plate in a lowered position.
Figure 3E:
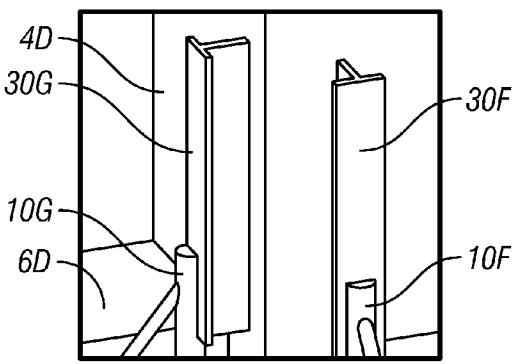
FIG. 3E is a schematic detailed perspective view of a corner of the floating offshore platform shown in FIG. 3D with the truss wall in a lowered position.
Figure 3C:
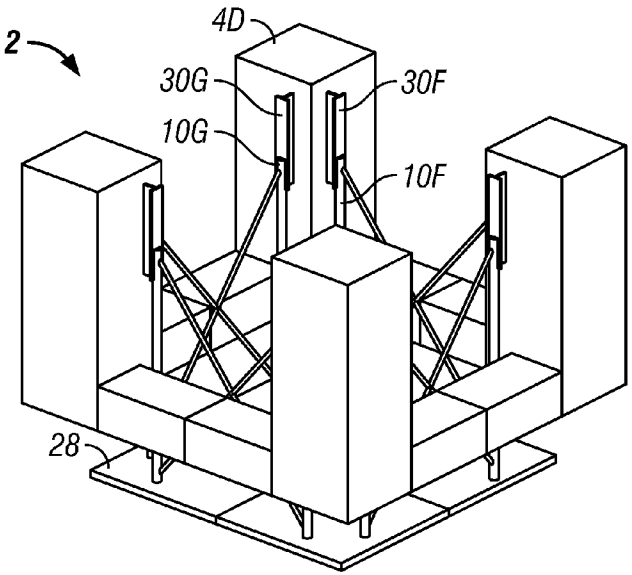
FIG. 3C is a schematic perspective view of the floating offshore platform shown in FIG. 3B with leg extension supports coupled to the truss wall in the partially lowered position.

FIG. 3A is a schematic perspective view of another embodiment of the floating offshore platform having truss walls and a heave plate in a raised position. FIG. 3B is a schematic perspective view of the floating offshore platform with the heave plate in a partially lowered position. FIG. 3C is a schematic perspective view of the floating offshore platform shown in FIG. 3B with leg extension supports coupled to the truss wall in the partially lowered position. FIG. 3D is a schematic perspective view of the floating offshore platform with the heave plate in a lowered position. FIG. 3E is a schematic detailed perspective view of a corner of the floating offshore platform shown in FIG. 3D with the truss wall in a lowered position. The figures will be described in conjunction with each other.

The offshore platform 2 can be similarly arranged as described above except that the truss legs 10 can be coupled to the relevant column 4, directly or through an intermediate member, to secure the truss legs at a vertical elevation. In many embodiments, a topsides (not shown) disposed above the columns 4 limits the length of the truss legs 10 that generally do not extend through the topsides. Thus, the truss legs 10 may not be sufficiently long enough for the heave plate 28 to be lowered to a full desired depth below the water surface. A leg support 30 can act as an intermediate member to effectively extend the truss legs 10 for coupling to the columns 4, once the truss legs have been partially lowered to allow the leg support to be inserted under the topsides. Further, if the truss leg is below the surface of the water, coupling of the truss leg to the column is more challenging and expensive. For example, the offshore platform 2 can include the columns 4A, 4D, with a truss wall 8D disposed therebetween. The truss wall 8D can include truss legs 10G, 10H with bracing therebetween. The heave plate 28 can be partially lowered, so that the truss wall 8D is also partially lowered along the columns 4A, 4D. As shown more specifically in FIG. 3C, a leg support 30G can be coupled such as by welding, to the truss leg 10G, and a corresponding leg support (not shown) coupled to the truss leg 10H. The coupling of the leg support to the truss leg can occur above a water surface to facilitate coupling before the coupling location is lowered to a final elevation below a water surface with the heave plate. In general, the leg support 30G is coupled to the column 4D after the truss leg 10G and leg support 30G with the heave plate is at the final elevation, as shown in FIGS. 3D, 3E. The leg support 30G can then be coupled with the column 4D, advantageously above the water surface, in a fixed vertical position as desired for the heave plate 28 elevation. Other truss legs can be similarly coupled with the leg supports, such as truss leg 10F coupled with leg support 30F.

In alternative embodiments, the topsides can be sized relative to the columns 4 and the truss walls 8, so that the truss legs 10 of the truss walls can extend above the topsides. In such embodiments, the length of the truss legs 10 can be sufficiently long, so that the leg supports 30 are unnecessary to extend the truss legs. The initial length of the truss legs can allow coupling of the truss legs 10 to the columns 4 above the water surface after the heave plate 28 has been lowered to a final position.

Other and further embodiments utilizing one or more aspects of the inventions described above can be devised without departing from the spirit of Applicant's invention. For example, it is also possible to first rest the truss assembly and heave plate on a seabed and then to pick them up when the offshore platform is in position above the truss assembly and heave plate. This alternative allows a longer-than-hull truss assembly length and can be combined with higher porches for welding or other coupling. Other variations are possible.

Further, the various methods and embodiments described herein can be included in combination with each other to produce variations of the disclosed methods and embodiments. Discussion of singular elements can include plural elements and vice-versa. References to at least one item followed by a reference to the item may include one or more items. Also, various aspects of the embodiments could be used in conjunction with each other to accomplish the understood goals of the disclosure. Unless the context requires otherwise, the word "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unitary fashion. The coupling may occur in any direction, including rotationally.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Apparent modifications and alterations to the described embodiments are available to those of ordinary skill in the art given the disclosure contained herein. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope or range of equivalent of the following claims.

What is claimed is:

1. An offshore platform, comprising:

a floating structure comprising:

a pontoon adapted to be disposed at least partially below a surface of water in which the offshore platform is disposed; and at least three vertically extending columns coupled to the pontoon, the columns having a larger lateral dimension than the pontoon coupled to the column, thereby creating a pontoon offset portion;

a truss assembly coupled to the floating structure and comprising:

at least three separated walls of trusses slidably coupled to the columns, each truss wall having at least two vertically disposed truss legs, and wherein a first leg of a first wall slidably coupled to any of the column is independent of a first leg of a second wall slidably coupled to the same column; and cross-bracing between the at least two vertically disposed truss legs of each truss wall; and a heave plate coupled to the truss assembly.

2. The offshore platform of claim 1, further comprising a porch coupled to the column adjacent the pontoon, forming a guide channel between the pontoon and the porch for the truss leg to be slidably disposed therethrough.

3. The offshore platform of claim 1, further comprising:

a porch coupled to the column adjacent the pontoon, forming a guide channel between the pontoon and the porch for the truss leg to be slidably disposed therethrough, and a leg support coupled to the truss leg and adapted to be coupled to the porch when the heave plate is in a lowered position.

4. The offshore platform of claim 1, further comprising:

a pair of porches coupled to the column adjacent a pair of pontoons, forming a pair of guide channels between the pontoons and the porch for a pair of truss walls to be independently and slidably disposed therethrough.

5. The offshore platform of claim 1, further comprising:

a pair of porches coupled to the column adjacent a pair of pontoons, forming a pair of guide channels between the pontoons and the porch for a pair of truss walls to be independently and slidably disposed therethrough, and a plurality of leg supports coupled to the pair of truss walls and adapted to be coupled to the pair of porches when the heave plate is in a lowered position.

6. The offshore platform of claim 1, further comprising:

a porch coupled to the column adjacent the pontoon, forming a guide channel between the pontoon and the porch for the truss leg to be slidably disposed therethrough, and a leg support coupled to the truss leg and adapted to be coupled to the porch when the heave plate is in a lowered position and the leg support is above a surface of water in which the offshore platform is disposed.

7. The offshore platform of claim 1, wherein a pair of columns coupled to a pontoon are each coupled to a porch adjacent the pontoon, forming a pair of guide channels between the pontoon and the pair of porches, the guide channels adapted to guide a truss wall having the at least two truss legs slidably disposed therethrough.

8. The offshore platform of claim 1, further comprising at least one leg support coupled to at least one of the truss legs and adapted to extend a vertical length of the at least one truss leg when the truss leg has been at least partially lowered.

9. The offshore platform of claim 1, wherein at least one truss leg extends about the top of the columns and is adapted to be coupled to the column above a surface of water in which the offshore platform is disposed when the heave plate is in a lowered position.

10. A method of lowering a heave plate of a floating offshore platform, the offshore platform having a floating structure with at least three vertically extending columns coupled to a pontoon creating a pontoon offset portion and a truss assembly coupled to the floating structure having at least three walls of trusses coupled to the heave plate, each truss wall having at least two vertically disposed truss legs, and wherein a first leg of a first wall slidably coupled to any of the column is independent of a first leg of a second wall slidably coupled to the same column, the method comprising:

lowering each truss wall while guiding the at least two vertically disposed truss legs of the truss wall at the pontoon offset portion; and supporting the at least two vertically disposed truss legs of the truss walls from the pontoon in a lowered position independently of the legs of an adjacent truss wall.

11. The method of claim 10, wherein the offshore platform comprises a porch coupled to the pontoon offset portion adjacent the pontoon and at least two of the truss legs each comprises a leg support, the method further comprising:

lowering the leg support while lowering the truss wall; and supporting the leg support by the porch when the heave plate is in the lowered position.

12. The method of claim 10, wherein at least two of the truss legs each comprises a leg support, the method further comprising:

partially lowering the leg support with the heave plate;

coupling the leg support to the truss leg in the partially lowered position;

lowering the truss legs; and coupling the leg support to the column.

13. The method of claim 10, wherein at least two of the truss legs each comprises a leg support, the method further comprising:

partially lowering the leg support with the heave plate;

coupling the leg support to the truss leg in the partially lowered position;

lowering the truss legs; and coupling the leg support to the column above a surface of water in which the offshore platform is disposed.

* * * * *